United States Patent [19]

Beckmann et al.

[11] Patent Number: 4,589,701

[45] Date of Patent: May 20, 1986

[54] CUTTING MACHINE

[75] Inventors: Klaus Beckmann, Lünen; Kunibert Becker, Werl, both of Fed. Rep. of Germany

[73] Assignee: Gewerkschaft Eisenhutte Westfalia, Lünen, Fed. Rep. of Germany

[21] Appl. No.: 637,256

[22] Filed: Aug. 3, 1984

[30] Foreign Application Priority Data

Aug. 3, 1983 [DE] Fed. Rep. of Germany ..... 3327941

[51] Int. Cl.[4] ..... E21C 27/00

[52] U.S. Cl. ..... 299/72; 299/64; 299/75

[58] Field of Search ..... 299/71, 42, 43, 72, 299/75, 76, 78; 173/22, 28, 38, 39; 52/115, 119, 120

[56] References Cited

U.S. PATENT DOCUMENTS

| | | | |
|---|---|---|---|
| 3,306,663 | 2/1967 | Webster | 299/56 X |
| 3,467,436 | 9/1969 | Pentith et al. | 299/75 X |
| 4,245,441 | 1/1981 | Smith, Jr. | 52/119 X |
| 4,248,481 | 2/1981 | Stoltefuss | 299/71 X |
| 4,277,105 | 7/1981 | Taylor | 299/76 X |

FOREIGN PATENT DOCUMENTS

| | | | |
|---|---|---|---|
| 2218921 | 10/1973 | Fed. Rep. of Germany | 299/72 |
| 443975 | 12/1974 | U.S.S.R. | 299/71 |

*Primary Examiner*—Stephen J. Novosad
*Assistant Examiner*—Thomas J. Odar
*Attorney, Agent, or Firm*—Sughrue, Mion, Zinn, Macpeak and Seas

[57] ABSTRACT

A cutting (winning) machine comprises a frame which is provided with a pair of endless drive tracks. A mast is pivotally mounted on the frame for movement between an upright working position and a non-working position (in which it lies substantially flat on the frame). The frame also supports a platform, which is also pivotal relative thereto in the vertical plane. A carriage is arranged to move along the mast, the carriage supporting a cutting head such as a shearer drum. The mast can be positioned in an upright position at either end of the frame, so that the machine can carry out work in both directions of travel.

18 Claims, 7 Drawing Figures

CUTTING MACHINE

BACKGROUND TO THE INVENTION

This invention relates to a cutting machine, and in particular to a winning machine for cutting coal in thick and/or steeply-inclined seams.

Cutting machines are known for winning mineral material such as coal, and for driving underground roadways. Machines of this type have a frame supported by an endless drive track system. A cutting arm, which is pivotally mounted to the frame for movement in the vertical plane, carries a cutting head at its free end. The range of action of the cutting head is determined by the length of the cutting arm, and the extent to which the cutting arm can pivot in the vertical and lateral directions. This range of action is limited by the dimensions and weight of the machine. The frame of this known type of cutting machine is usually provided with a transverse conveyor for receiving won material heaped on the floor of the working, as well as with an off-take (or loading) conveyor disposed downstream of the transverse conveyor. This known type of machine is also designed so that it can carry out winning (or cutting) on a mineral face in one direction of travel only.

The object of the invention is to provide a cutting machine which has a considerably increased zone of action, particularly as regards cutting height, but which has a relatively small overall height when not involved in cutting work. Another object is to provide a cutting machine which can carry out work in both directions of travel.

SUMMARY OF THE INVENTION

The present invention provides a cutting machine comprising a frame having a longitudinal axis, a mast pivotally mounted on the frame for movement between an upright working position and a down-swung non-working position, a carriage slidably mounted on the mast, and a cutting head mounted on the carriage, the cutting head being movable relative to the carriage in a direction which is lateral to the direction of movement of the carriage along the mast.

This machine is intended primarily, for winning coal (or other mineral material) from thick and/or inclined seams, and in particular for winning inclined seams involving the double-winged roof construction method. However, the machine can be used for face-working and/or roadway (or tunnel) driving in all circumstances in which comparable operating conditions exist, that is to say, where an especially large range of action is required on the part of the machine.

This machine has a mast which can be swung up from a non-working position (in which it lies flat on, or above, the machine frame), into an upright, substantially vertical working position. The actual cutting head can be moved upwards and downwards on this mast together with the carriage, which could also be provided with guide rollers. Accordingly, if the mast is of appropriate length, the cutting head has a large range of action in the vertical direction, which range may be 6 to 10 meters or more. Since the mast can be lowered flat on to the machine frame, the machine has a relatively small height when the mast is in this non-working position, so that the machine can be moved and manoeuvered without difficulty in mine workings whose height is considerably less than the vertical range of action of the machine.

Advantageously, the frame is supported on a pair of endless drive tracks which are parallel to the longitudinal axis of the frame.

In a preferred embodiment, the mast is pivotally mounted on the frame by means of a pivot bearing positioned adjacent to one end of the frame, said pivot bearing having a pivotal axis which extends transversely with respect to the longitudinal axis of the frame. Preferably, the frame is provided with a pivot bearing adjacent to each end thereof, and the mast is provided with complementary pivot connections adjacent to the two ends thereof, each pivot connection being engageable with a respective pivot bearing to form a respective detachable pivot joint, the pivot connections being spaced apart by the same distance as the pivot bearings, whereby the mast can be positioned in upright working positions at either end of the frame, in each of which working positions the mast is supported by the pivot joint at that end of the frame, and whereby the mast can be positioned in a substantially horizontal non-working position, in which the mast is supported by both pivot joints. The double-pivotal arrangement of the mast enables the machine to operate in both directions of travel. Thus, the mast can be swung up to the vertical position while supported either in the front or the rear pivot bearing, the cutting unit being able to carry out work in one direction of travel when the mast is in one position, whereas it can carry out work in the other direction of travel of the machine, when the mast is in the other position.

Advantageously, the cutting machine further comprises a swivel mechanism for moving the mast between its working and non-working positions. Preferably, the swivel mechanism comprises two hydraulic rams which are inclined towards one another, first ends of the rams being connected to the mast at substantially the same region thereof, second ends of the rams being connected to the frame at connection positions spaced apart in the direction of its longitudinal axis. Said first ends of the rams may be connected to the mast, at the central region thereof, by a common pivot joint. In this arrangement, one of the connection positions is located at the front end of the frame, and the other connection position is located at the opposite end thereof. This arrangement of the rams in the form of a "force triangle" enables the mast to be moved from its down-swung position to either side over a range of more than 100°. This pivotal movement is also used to apply the cutting head to the work face with a predetermined force.

In order to increase the range of action of the machine further, the cutting head may be mounted on a support member which is rotatably mounted on the carriage for rotation about an axis extending at right-angles to the direction of movement of the carriage along the mast. This arrangement enables the cutting head to work at either a high level or a low level.

Advantageously, the cutting head is mounted at one end of a swivel arm, the other end of the swivel arm being pivotted to the support member about an axis which is parallel to the longitudinal axis of the frame. Preferably, said other end of the swivel arm is pivotally mounted on a body member fixed to the support member. In order to achieve the required cutting profile, the swivel arm may be of two-part construction, the two parts of the swivel arm being pivotally connected together. Preferably, the cutting head includes a shearer drum which is rotatable about an axis which is parallel to the longitudinal axis of the frame.

In order to relieve the endless drive tracks of load, and to stabilise the machine during operations, the mast and the frame may be provided with laterally-extensible bracing claws.

Advantageously, the mast is provided with a pair of parallel tubular guides, the carriage is slidably mounted on said guides, and the carriage is movable along the mast by a screw-threaded spindle drive.

In a preferred embodiment, the cutting machine further comprises a telescopically-extensible operator's platform which is mounted on the frame for pivotal movement relative thereto in a vertical plane. This platform is used for carrying out additional operations, in particular operations such as the setting of roof anchors for securing the roof. Advantageously, the platform is pivotally mounted at one end of a telescopically-extensible arm, the other end of said arm being pivotally mounted on the frame, and the arrangement being such that the platform can be pivotted towards said arm whereby, when said arm is lowered, the platform can be positioned on the frame in a substantially horizontal attitude. Preferably, the mast and the platform are such that the mast can be lowered into its non-working position after the platform has been lowered onto the frame, the platform being then positioned beneath the mast. Conveniently, the platform is arranged to be moved sideways on the telescopic arm (or it can comprise a part which can be moved out to the side) so as to enable the roof to be reached over its full width.

In a preferred embodiment, the cutting machine further comprises a transverse conveyor arranged at one end of the frame, and a longitudinally-extending conveyor supported by the frame and arranged to receive material discharged from the transverse conveyor. The longitudinally-extending (discharge) conveyor can be connected to a bridge interconnecting the endless drive tracks. This bridge forms part of the frame and supports the mast and the platform. If the machine is to operate in both directions of travel, it can be provided with a further transverse conveyor at the other end thereof. It is, however, also possible to arrange the first-mentioned transverse conveyor in such a way that, if required, it can be transported from the front end to the rear end of the frame.

BRIEF DESCRIPTION OF THE DRAWINGS

A cutting machine constructed in accordance with the invention will now be described in detail, by way of example, with reference to the accompanying drawings, in which.

DESCRIPTION OF PREFERRED EMBODIMENT

Figure 1:
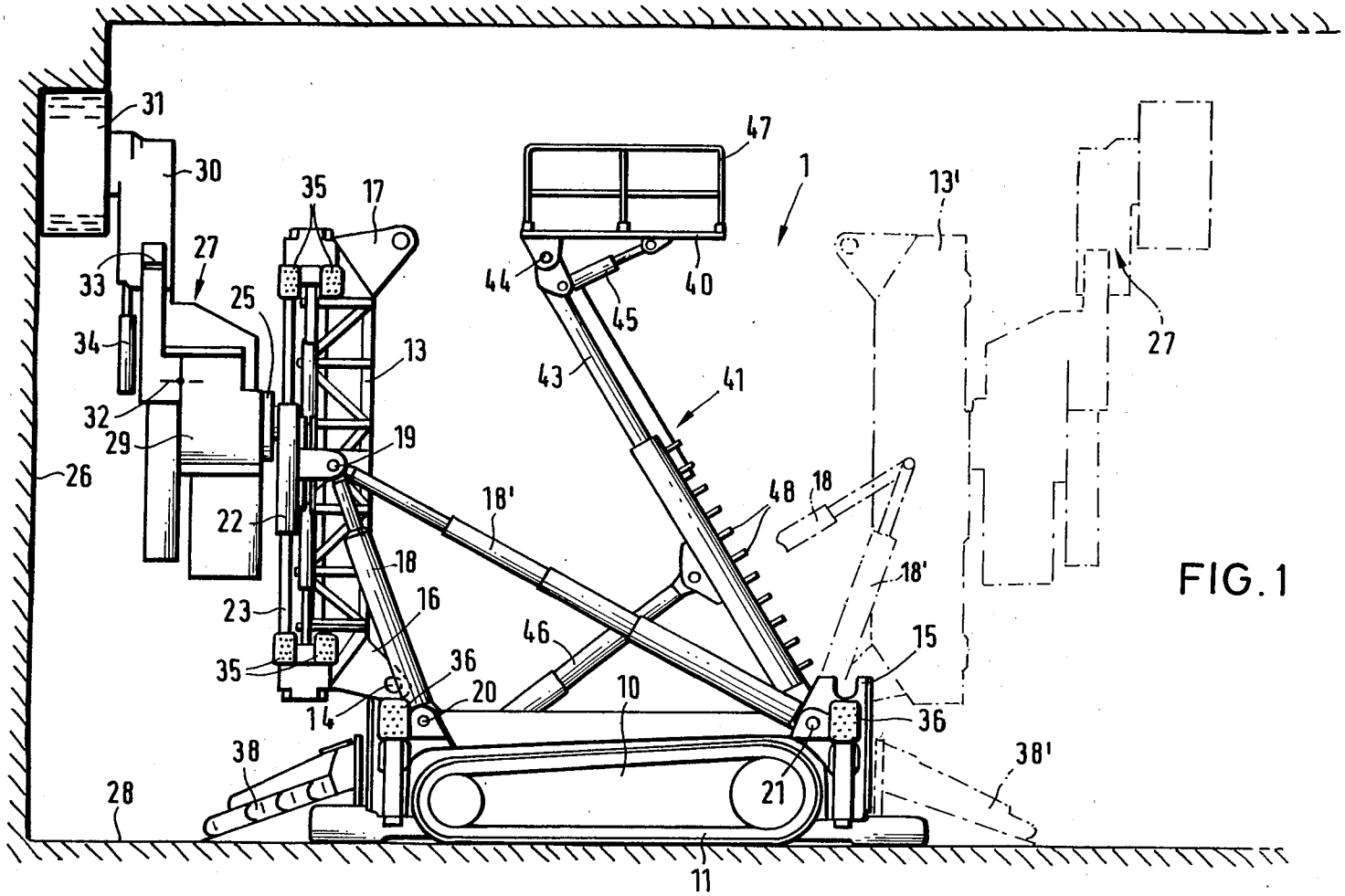
FIG. 1 is a side elevation of the cutting machine, and shows the cutting head thereof in a working position.

Referring to the drawings, FIG. 1 shows a cutting machine 1 having a frame 10 whose chassis is supported by a pair of endless tracks 11 which are interconnected by a bridge 12. A mast 13 of lattice construction is mounted on the frame 10. At its front and rear ends, the frame 10 is provided with respective pivot bearings 14 and 15. At each of its two ends, the mast 13 is provided with respective pivot arms 16 and 17 which carry pivot pins cooperable with the pivot bearings 14 and 15. The distance between the pivot pins of the two pivot arms 16 and 17 is equal to the distance between the pivot bearings 14 and 15. As shown in FIG. 1, the mast 13 is pivotally mounted on the frame 10 by a pivot joint constituted by the pivot bearing 14 and the pivot pin of the pivot arm 16. Alternatively, as shown in dash-dot lines 13' at the right of FIG. 1, the mast could be pivotally mounted on the frame 10 by a pivot joint constituted by the pivot bearing 15 and the pivot pin of the pivot arm 17. These pivot joints are readily releasable, so that the mast 13 can be moved easily between its two working positions.

The mast 13 is movable between its two working positions (and into a non-working position, in which it lies horizontally on the frame 10 with both pivot joints engaged) by means of two multi-stage hydraulic rams 18 and 18'. The rams 18 and 18' are inclined towards one another, and engage in a common pivot joint 19 at the rear side of the mast 13 and at the middle thereof. The cylinders of the rams 18 and 18' are supported by respective pivot joints 20 and 21 on the frame 10. The pivot joint 20 is located at the front end of the frame 10, and the pivot joint 21 is positioned at the rear end thereof. Instead of having a common pivot joint 19, the two rams 18 and 18' may be connected to the mast 13 by separate pivot joints. In this case, the axes of the two pivot joints would be conincident.

This "triangular" arrangement of the two rams 18 and 18' enables the mast 13 to be swung up, from its non-working position (see FIG. 3), to either of its working positions. As shown in FIG. 1, the mast 13 is swung to the left through about 90° from the non-working position. In this position, the ram 18' is extended further than the ram 18. On the other hand, when the mast 13 is swung up to the right (as shown at 13' by dash-dot lines in FIG. 1), the ram 18 is extended further than the ram 18'. Thus, the mast 13 can be swung up, as required, to either side through an angle of at least 90° (and preferably through a greater angle). The rams 18 and 18' are also used for applying the cutting head (to be described below) against a work face 26 with a predetermined force.

Figure 2:
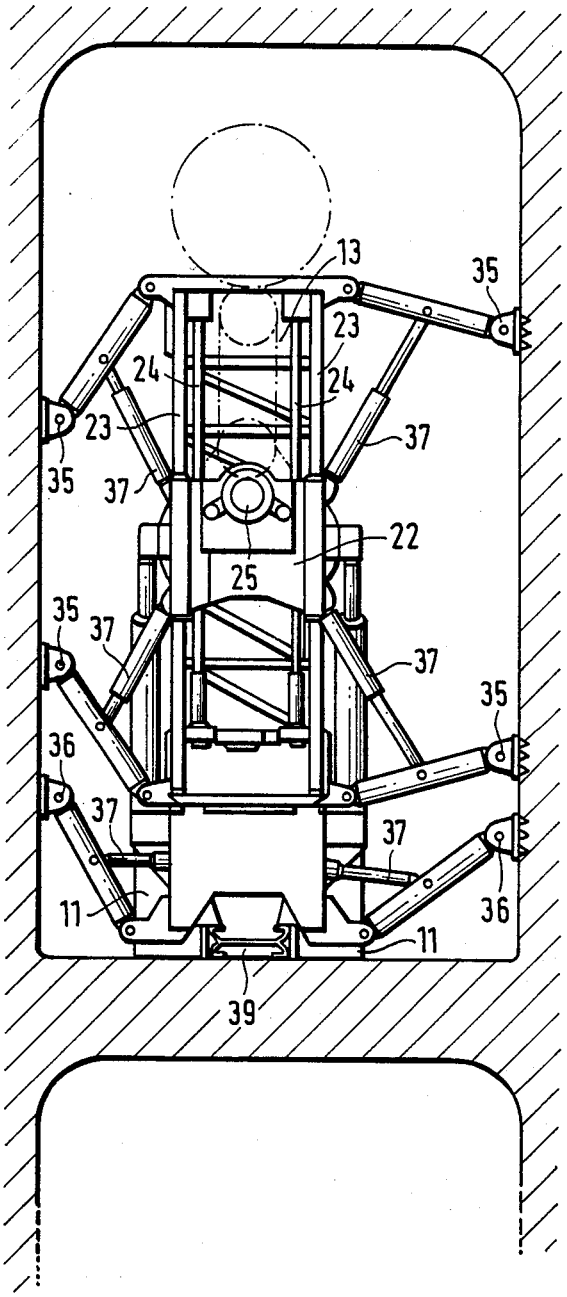
FIG. 2 is an end elevation, looking from a work face being cut, of the cutting machine.

A carriage 22 is slidably mounted on two tubular guides 23, which extend over substantially the entire length of the mast 13. The carriage 22 can be moved in the longitudinal direction, with respect to the mast 13, by means of screw-threaded spindles 24 (see FIG. 2), which are powered by a drive (not shown) mounted on the mast.

A support 25 is mounted on the carriage 22, the support being rotatable by means of a drive (not shown) mounted on the carriage 22. The support 25 is rotatable about a horizontal axis which extends at right-angles to the guides 23 and is directed towards the work face 26. The support 25 carries a cutting head 27, and is constituted by a plate. The arrangement is such that the support 25 can be detachably coupled to the carriage 22 by means of, for example, hydraulically or pneumatically loaded cotter bolts. The coupling is releasable to enable the cutting head 27 to be swung through an angle of 200° across the floor 28, from the working position shown in FIG. 1, to either side.

The cutting head 27 is a shearer, having a body 29 fixed to the support 25. The body 29 accommodates a drive (not shown) for the cutting head 27. A swivel arm 30 is pivotally mounted on the body 29, for pivotal movement about a pivot joint 32 having a horizontal axis. The swivel arm carries a shearer drum 31 which rotates about an axis extending towards the work face 26. The swivel arm 30 can be swung about the pivot joint 32 by means of hydraulic rams (not shown). The swivel arm 30 is of two-part construction, the two parts being joined by a pivot joint 33 whose axis extends parallel to the axis of the pivot joint 32. A hydraulic ram 34 is provided to pivot the two parts of the swivel arm 30, the ram 34 being between the two parts of the swivel arm.

It will be seen that the cutting head 27 can be moved upwards and downwards on the mast 13, and that it can also be pivoted through substantially 400° relatively to the mast about the axis of the support 25 that extends towards the work face 26. Moreover, the shearer drum 31 can be moved to either side by pivoting the swivel arm 30 in the pivot joints 32 and 33. Thus, for example, the upright rectangular profile shown in FIG. 2 can be cut.

In order to stabilise the mast 13 and the frame 10 during cutting operations, and to relieve the endless tracks 11 of the load, the mast and the frame are provided at each side with bracing claws 35 and 36 respectively. The bracing claws 35 and 36 are provided with hydraulic rams 37 which can be extended to press the claws against the side faces of the working (see FIG. 2).

A transverse conveyor 38 is mounted at the front of the frame 10. The level of the transverse conveyor 38 can be adjusted to receive heaped cut material lying on the floor 28, and to carry this material to a discharge conveyor 39 (see FIG. 2). The conveyor 39 is disposed below the bridge 12 of the frame 10 and between the two endless tracks 11. The conveyor 39 is fixed to the bridge 12, so that it moves together with the machine. A corresponding transverse conveyor 38' (shown in dash-dot lines in FIG. 1) can be provided at the opposite end of the frame 10. The conveyor 38' is used to load material on to the conveyor 39 when the direction of travel of the machine is changed, that is to say when the mast 13 is located in the working position (13') at the other end of the frame 10.

Figure 4:
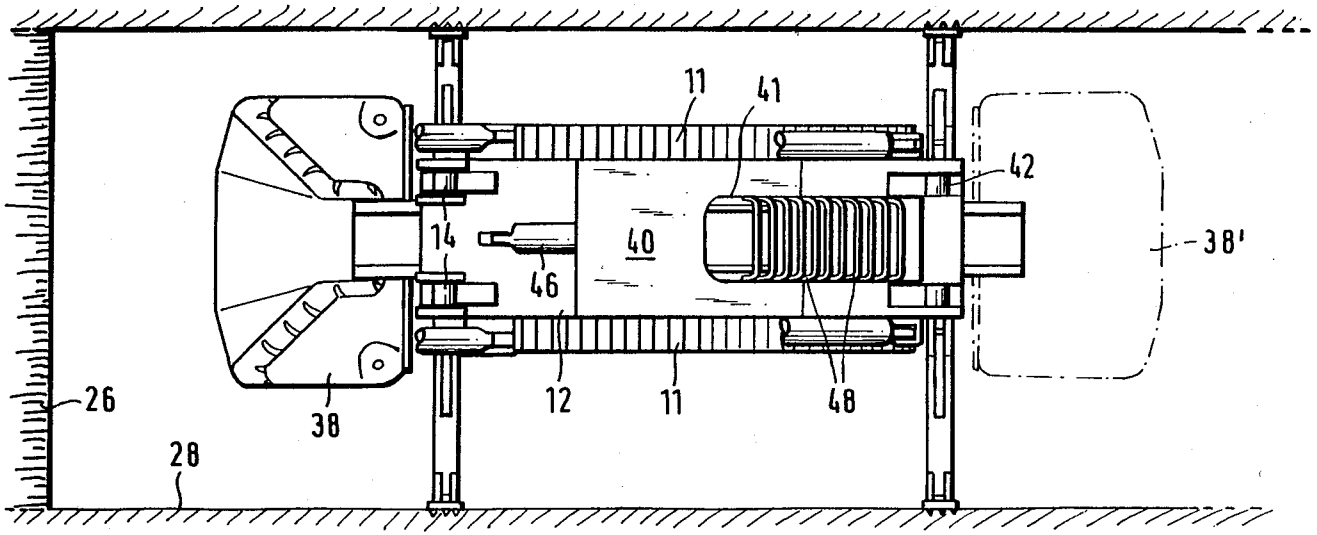
Fig. 4 is a plan view of the frame of the cutting machine, the upper parts of the machine being omitted so as not to complicate the figure.

An operator's platform 40 is mounted on the frame 10 (that is to say on the bridge 12) by means of a telescopic arm 41. The arm 41 is connected to the bridge 12 by a pivot joint 42 (see FIG. 4), which is positioned adjacent to the pivot bearing 15. The telescopic arm 41 has an extensible part 43 which carries the platform 40, the platform being connected to said part by a pivot joint 44. A hydraulic ram 45 is provided to pivot the platform 40 relatively to the telescopic arm 41 from the illustrated operating position into a rest position. The telescopic arm 41 itself can be swung upwards and downwards by means of a hydraulic ram 46, which is supported on the frame 10. When not in use, the extensible part 43 of the arm is retracted into the telescopic arm 41, and the platform 40 is swung flat on to the telescopic arm using the ram 45. Thereafter, the telescopic arm 41 is swung down, by the ram 46, to lie substantially horizontal on the frame 10 (see FIG. 4). A handrail 47, provided on the platform 40, can be removed or swung down flat on to the platform. The telescopic arm 41 is provided with a ladder having rungs 48.

Figure 3:
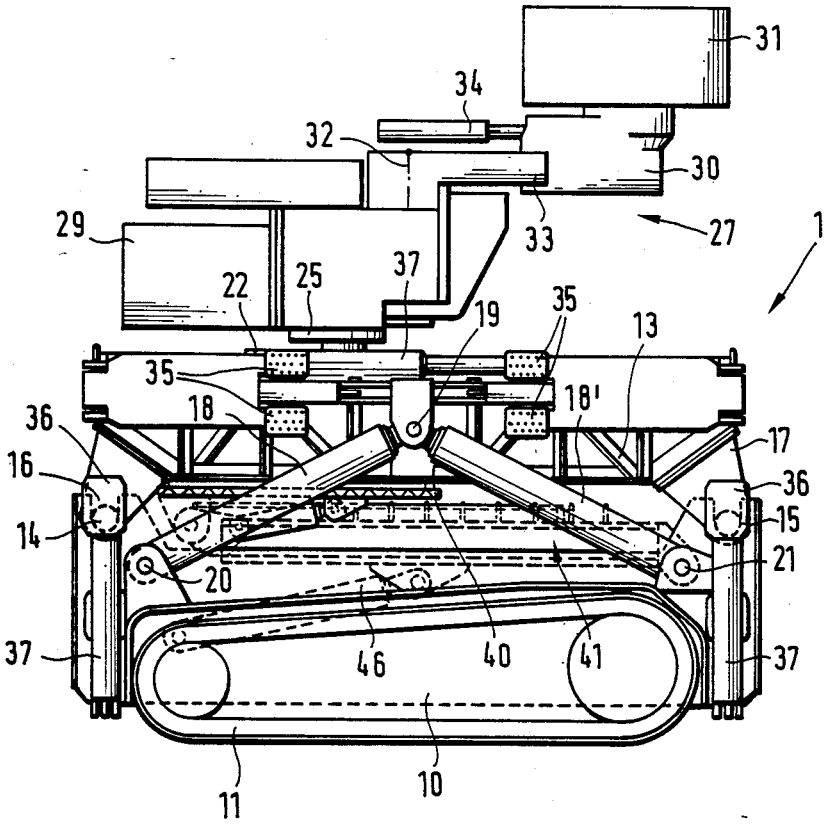
FIG. 3 is a side elevation of the cutting machine, and shows the cutting head thereof in a non-working position.

Once the platform 40 has been lowered into the rest position on the frame 10, the mast 13 together with the cutting head 27 can be swung down, by the rams 18 and 18', over the platform and on to the frame (see FIG. 3). In this position, the cutting head 27 is located above the mast 13, and the vertical dimension of the machine is considerably smaller than when the mast and the platform 40 are in the swung up position.

The cutting machine described above can operate on the work face 26 at a height ranging from 6 to 12 meters (or more), without the machine being too heavy and too large. During the cutting work, the platform 40 can be swung up towards the roof of the working. The roof can then be rendered safe by suitable anchoring means (not shown).

Figures 5A, 5B, 5C:
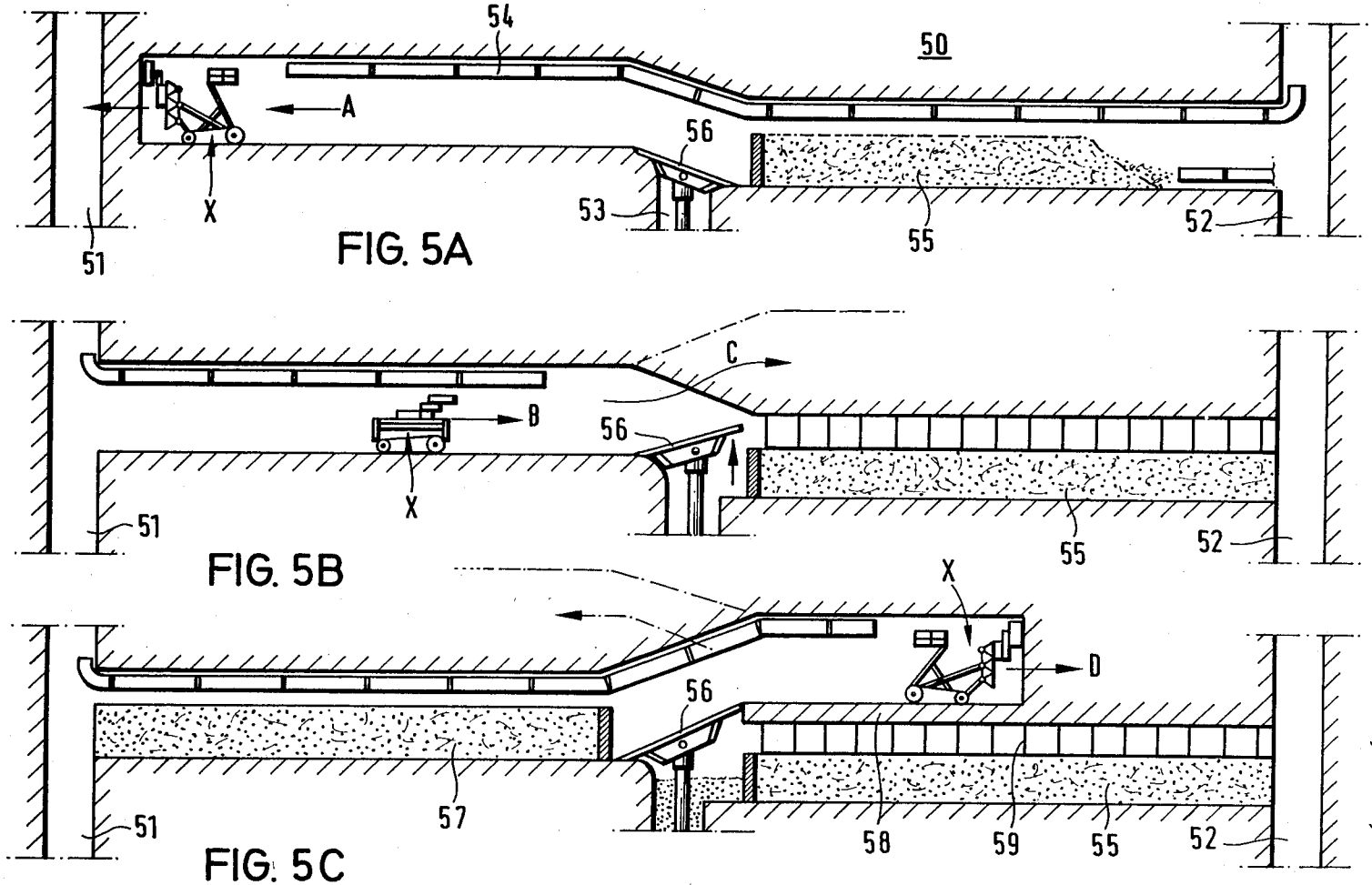
FIGS. 5A, 5B and 5C illustrate diagrammatically a preferred use of the cutting machine.

FIGS. 5A to 5C show schematically the use of the cutting machine to win coal from an inclined seam, using what is known as the continuous roof construction method which involves a two-wing winning operation. The cutting machine shown in FIGS. 1 to 4 is here indicated diagrammatically by the reference X. The winning of a steep and very thick coal seam 50 is carried out between two roadways 51 and 52. A third roadway 53 is formed midway between the roadways 51 and 52, this third roadway being provided to enable the two-wing winning operation to be carried out. The winning operation commences at a dip in the seam 50, and is carried out in strips which go to-and-fro between the roadways 51 and 52. As shown in FIG. 5A, the cutting machine X moves to the left in the direction shown by the arrow A. The machine X wins the seam 50 over its entire thickness (which, because of the steep incline of the seam, may be thought of as its width), which may be 3 to 5 meters, at a height of 6 to 10 meters, for example. The coal won is transferred to the roadway 53 by the conveyors 38 and 39. When the machine X reaches the roadway 53, it passes thereover on an inclined ramp 56. As the machine X wins coal from the seam 50 in the region between the roadways 53 and 51, filling material 55 is blown into the zone between the roadways 52 and 53. As this happens, the zone between the roadways 53 and 51 is ventilated by an air duct 54. As soon as the cutting machine X reaches the roadway 51, it is moved back in the direction indicated by the arrow B (see FIG. 5B) with the platform 40 and the mast 13 swung down into their rest positions. When the machine X reaches the roadway 53, it runs upwardly over the ramp 56 in the direction indicated by the arrow C. As this occurs, the mast 13 and the cutting unit 27 are swung up to the other side of the machine X, so that the cutting unit can win coal from the portion of the seam 50 between the roadways 52 and 53 during its movement in the direction indicated by the arrow D (see FIG. 5C). At the same time, filling material 57 is introduced into the zone between the roadways 51 and 53. When the machine X reaches the roadway 52, it is reversed and the process repeated at a position higher up the seam 50.

In this way, the seam 50 is won upwardly using the roof construction method involving two-wing operations; and, during winning of one of the wings, filling material is introduced into the other. Working at the next highest level is carried out in such a manner that a sufficiently thick bank 58 of coal is left untouched, this being underpinned by, for example, inserted wooden roof support 59, which is braced on the filling material 55 or 57. Since the machine X cay carry out winning work in both directions of travel, it is not necessary to turn the machine round when it reaches one of the end roadways 51 or 52.

The cutting machine described above could also be used for winning very thick seams which are not inclined. In this case, the seam could be won in one cut over its entire thickness. The machine could also be used as a tunnel drive machine.

We claim:

1. A cutting machine, comprising: a frame (10) having a longitudinal axis, a mast (13) pivotally mounted on the frame for movement between an upright working position and a down-swung non-working position, a carriage (22) slidably mounted on the mast, and a cutting head (27) mounted on the carriage, the cutting head being movable relative to the carriage in a direction which is lateral to the direction of movement of the carriage along the mast, wherein the frame is supported on a pair of endless drive tracks (11) which are parallel to the longitudinal axis of the frame, wherein the frame is provided with a pivot bearing (14, 15) adjacent to each end thereof, each pivot bearing having a pivotal axis which extends transversely with respect to the longitudinal axis of the frame, and wherein the mast is provided with complementary pivot connections (16, 17) adjacent to the two ends thereof, each pivot connection being engageable with a respective pivot bearing to form a respective detachable pivot joint, the pivot connections being spaced apart by the same distance as the pivot bearings, whereby the mast can be positioned in upright working positions at either end of the frame, in each of which working positions the mast is supported by the pivot joint at that end of the frame, and whereby the mast can be positioned in a substantially horizontal non-working position, in which the mast is supported by both pivot joints.

2. A cutting machine according to claim 1, further comprising a swivel mechanism for moving the mast between its working and non-working positions.

3. A cutting machine according to claim 2, wherein the swivel mechanism comprises two hydraulic rams (18, 18') which are inclined towards one another, first ends of the rams being connected to the mast at substantially the same region thereof, second ends of the rams being connected to the frame at connection positions spaced apart in the direction of its longitudinal axis.

4. A cutting machine according to claim 1, wherein the cutting head is mounted on a support member (25) which is rotatably mounted on the carriage for rotation about an axis extending at right-angles to the direction of movement of the carriage along the mast.

5. A cutting machine according to claim 4, wherein the cutting head is mounted at one end of a swivel arm (30), the other end of the swivel arm being pivotted to the support member about an axis which is parallel to the longitudinal axis of the frame.

6. A cutting machine according to claim 5, wherein said other end of the swivel arm is pivotally mounted on a body member (29) fixed to the support member.

7. A cutting machine according to claim 5, wherein the swivel arm is of two-part construction, the two parts of the swivel arm being pivotally connected together.

8. A cutting machine according to claim 1, wherein the cutting head includes a shearer drum which is rotatable about an axis which is parallel to the longitudinal axis of the frame.

9. A cutting machine according to claim 1, wherein the mast is provided with laterally-extensible bracing claws.

10. A cutting machine according to claim 1, wherein the frame is provided with laterally-extensible bracing claws.

11. A cutting machine according to claim 1, wherein the mast is provided with a pair of parallel tubular guides (23), and wherein the carriage is slidably mounted on said guides.

12. A cutting machine according to claim 1, wherein the carriage is movable along the mast by a screw-threaded spindle drive (24).

13. A cutting machine according to claim 1, further comprising a telescopically-extensible operator's platform (40) which is mounted on the frame for pivotal movement relative thereto in a vertical plane.

14. A cutting machine according to claim 13, wherein the platform is pivotally mounted at one end of a telescopically-extensible arm (41), the other end of said arm being pivotally mounted on the frame, and the arrangement being such that the platform can be pivotted towards said arm whereby, when said arm is lowered, the platform can be positioned on the frame in a substantially horizontal attitude.

15. A cutting machine according to claim 14, wherein the mast and the platform are such that the mast can be lowered into its non-working position after the platform has been lowered onto the frame, the platform being then positioned beneath the mast.

16. A cutting machine according to claim 1, further comprising a transverse conveyor arranged at one end of the frame, and a longitudinally-extending conveyor supported by the frame and arranged to receive material discharged from the transverse conveyor.

17. A cutting machine according to claim 16, wherein the frame is provided with a further transverse conveyor at the other end thereof.

18. A cutting machine according to claim 1, wherein the frame includes a bridge (12) interconnecting the two endless drive tracks, the bridge supporting the mast.

* * * * *